US005239744A

United States Patent [19]

Fleming et al.

[11] Patent Number: 5,239,744

[45] Date of Patent: Aug. 31, 1993

[54] METHOD FOR MAKING MULTILAYER MAGNETIC COMPONENTS

[75] Inventors: Debra A. Fleming, Lake Hiawatha; David W. Johnson, Jr., Bedminster; Warren W. Rhodes, Raritan, all of N.J.; Apurba Roy, Rockwall, Tex.; John Thomson, Jr., Sprink Lake, N.J.

[73] Assignee: AT&T Bell Laboratories, Murray Hill, N.J.

[21] Appl. No.: 818,669

[22] Filed: Jan. 9, 1992

[51] Int. Cl.[5] ..... H01F 41/02

[52] U.S. Cl. ..... 29/602.1; 29/432; 264/59; 264/61; 264/272.15

[58] Field of Search ..... 29/602.1, 25.42, 605, 29/432; 264/272.15, 59, 61; 336/260

[56] References Cited

U.S. PATENT DOCUMENTS 3,768,144 10/1973 Heinss .
3,965,552 6/1976 Rutt ..... 29/25.42
4,301,580 11/1981 Wallace ..... 29/25.42
4,482,933 11/1984 Alexander .
4,584,629 4/1986 Garcia et al. .
4,652,967 3/1987 Sakabe et al. .
4,797,780 1/1989 Moser et al. .
4,819,128 4/1989 Florian et al. .
4,829,399 5/1989 Otto et al. .
4,913,932 4/1990 Moser et al. .

*Primary Examiner*—Carl E. Hall
*Attorney, Agent, or Firm*—Glen E. Books

[57] ABSTRACT

Multilayer magnetic components can be made with reduced cracking and magnetic degradation by forming layers having patterns of magnetic and insulating regions separated by regions that are removable during sintering. Advantageously, when the layers are stacked, layers of removable material are also disposed between magnetic regions and insulating regions so as to produce upon sintering a magnetic core within an insulating body wherein the core is substantially completely surrounded by a thin layer of free space.

7 Claims, 7 Drawing Sheets

METHOD FOR MAKING MULTILAYER MAGNETIC COMPONENTS

FIELD OF THE INVENTION

This invention relates to methods for making multilayer magnetic components such as transformers and inductors, and, in particular, to an improved method for making such components employing removable spacer regions to form separated magnetic regions within an insulating body.

BACKGROUND OF THE INVENTION

Static magnetic devices such as transformers and inductors are essential elements in a wide variety of circuits requiring energy storage and conversion, impedance matching, filtering, EMI suppression, voltage and current transformation, and resonance. As historically constructed, these devices tended to be bulky, heavy and expensive to fabricate as compared with other circuit components. Manual operations such as winding conductive wire around magnetic cores dominated production costs.

A new approach to the fabrication of such devices was described in U.S. application Ser. No. 07/695653 entitled "Multilayer Monolithic Magnetic Components and Method of Making Same" filed by Grader et al and assigned to applicants' assignee. In the Grader et al approach ceramic powders are mixed with organic binders to form magnetic and insulating (non-magnetic) green ceramic tapes, respectively. A magnetic device is made by forming layers having suitable two-dimensional patterns of magnetic and insulating regions and stacking the layers to form a structure with well-defined magnetic and insulating non-magnetic regions. Conductors are printed on the insulating regions as needed, and the resulting structure is laminated under low pressure in the range 500-3000 psi at a temperature of 60°-80° C. The laminated structure is fired at a temperature between 800° to 1400° C. to form a co-fired composite structure of the magnetic component.

Using this approach, one must take particular care that the materials used be thermally compatible with one another. The magnetic and the insulating materials must have compatible sintering rates and temperatures. Such compatibility is achieved, for example, by doping the insulating material with metals.

If the materials are not highly compatible, they tend to crack during the sintering process. Even if they do not crack, the residual stresses may significantly degrade the magnetic characteristics of the device through magnetostriction. Accordingly, there is a need for a method for making multilayer magnetic components that is more tolerant of differences in the sintering and thermal expansion properties of the constituent ceramic materials.

SUMMARY OF THE INVENTION

Applicants have discovered that multilayer magnetic components can be made with reduced cracking and magnetic degradation by forming layers having patterns of magnetic and insulating regions separated by regions that are removable during sintering. Advantageously, when the layers are stacked, layers of removable material are disposed between magnetic regions and insulating regions so as to produce upon sintering a magnetic core within an insulating body wherein the core is substantially completely surrounded by a thin layer of free space.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for purposes of illustrating the concepts of the invention and are not to scale.

DETAILED DESCRIPTION

Figure 1:
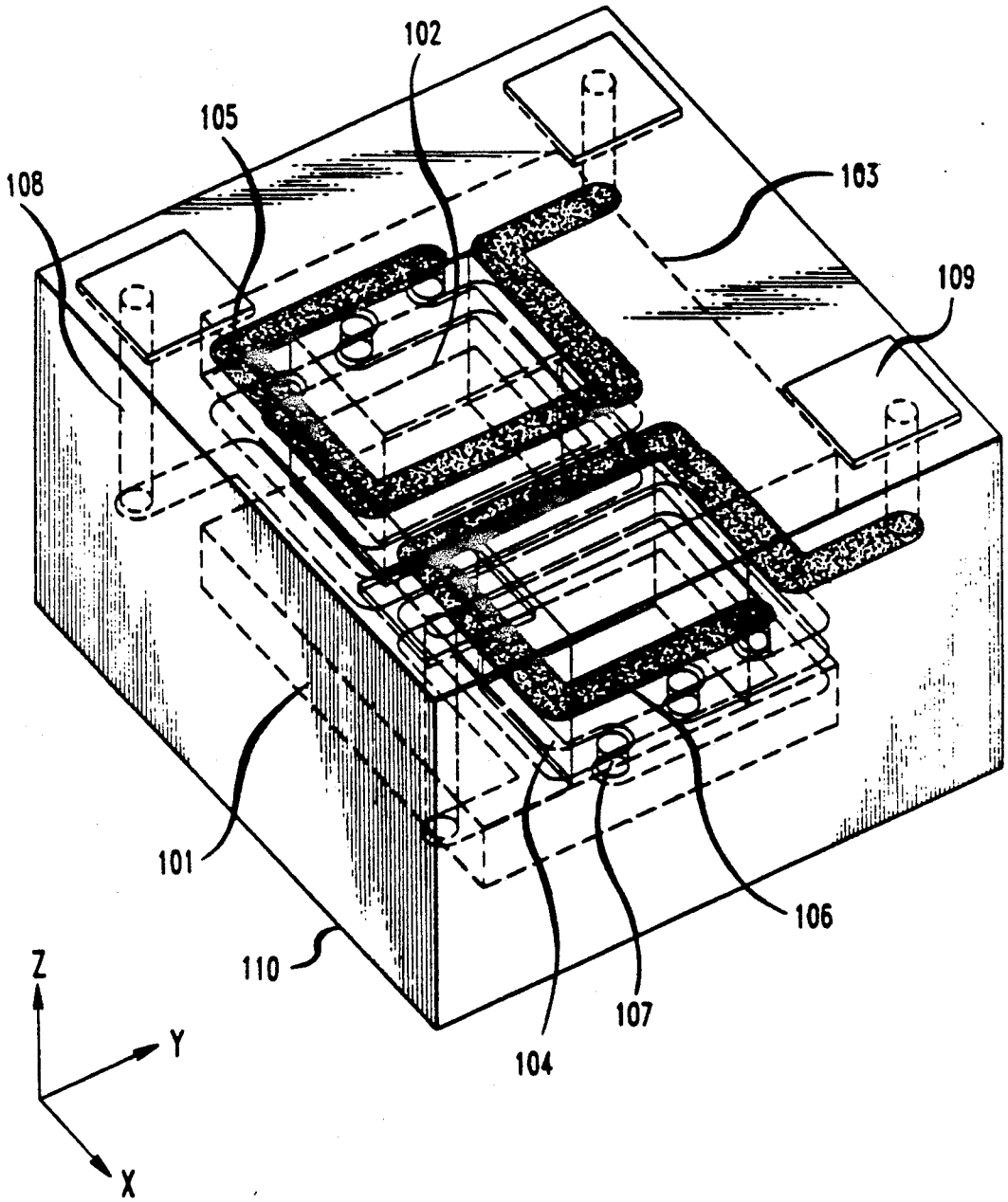
FIG. 1 is a three-dimensional, see-through line drawing of a completed composite magnetic device.

FIG. 1 is a three-dimensional see-through drawing of an exemplary composite magnetic device which can advantageously be made in accordance with the invention. This device is constructed as a multiple winding transformer having a toroidal magnetic core. The toroidal core comprises four sections 101 to 104, each of which is constructed from a plurality of high magnetic permeability ceramic green tape layers. Sections 102 and 104 are circumscribed by conductive windings 105 and 106, respectively. These windings form the primary and secondary of a transformer. Alternatively, the windings could be connected in series so that the structure functions as a multiple turn inductor. Windings 105 and 106 are formed by printing pairs of conductor turns onto a plurality of insulating non-magnetic ceramic green tape layers, each insulating non-magnetic layer having suitable apertures for containing the sections of magnetic green tape layered inserts and peripheral regions of removable material disposed between the non-magnetic material and the magnetic material. The turns printed on each layer are connected to turns of the other layers with conductive vias 107 (i.e. through holes filled with conductive material). Additional insulating non-magnetic layers are used to contain sections 101 and 103 of the magnetic tape sections and to form the top and bottom structure of the component. In each instance regions of removable material (not shown in FIG. 1) have been provided to separate the magnetic and non-magnetic regions. Conductive vias 108 are used to connect the ends of windings 105 and 106 to connector pads 109 on the top surface of the device. The insulating non-magnetic regions of the structure are denoted by 110. Current excitation of the windings 105 and 106 produces a magnetic flux in the closed magnetic path defined by sections 101–104 of the toroidal core. The fluxpath in this embodiment is in a vertical XZ plane.

The ceramic green tape layers used in the construction of the FIG. 1 device are advantageously those described in the aforementioned Grader et al application. Specifically, the ceramic materials can be spinel ferrites of the form $M_{1+x}Fe_{2-y}O_{4-z}$ where the values for x, y and z can assume both positive and negative numerical values. The M material normally includes at least one of the elements Mn, Ni, Zn, Fe, Cu, Co, Zr, V, Cd, Ti, Cr and Si. The high magnetic permeability material can be a MnZn ferrite and the insulating low permeability material can be a Ni ferrite. To minimize differences in sintering temperatures and rates, the low permeability Ni ferrite can be doped with copper oxide in an amount between 2 and 5%. The ferrites can be mixed in organic binders such as polyvinyl butyral, methyl cellulose or polyvinyl alcohol and formed into removable green tapes having typical thickness in the range 2–15 mils. It is understood that the terms "magnetic and "non-magnetic" as applied to such materials denote high permeability and low permeability materials, respectively. Conductors can be printed conductive inks containing particles of palladium or palladium-silver alloy such as are commercially available from Ceronics, Inc., Matawan, N.J.

In accordance with the invention, in the fabrication process the regions of high permeability material and low permeability material are separated by regions of removable material. A removable material is one which dissipates prior to completion of sintering by evaporation, sublimation, oxidation or pyrolysis. Such materials include polyethylene, cellulose, starch, nitrocellulose, and graphite. Particles of these materials can be mixed with the same kinds of organic binders as the ferrites and can be formed into tapes of equal thickness.

Figure 2:
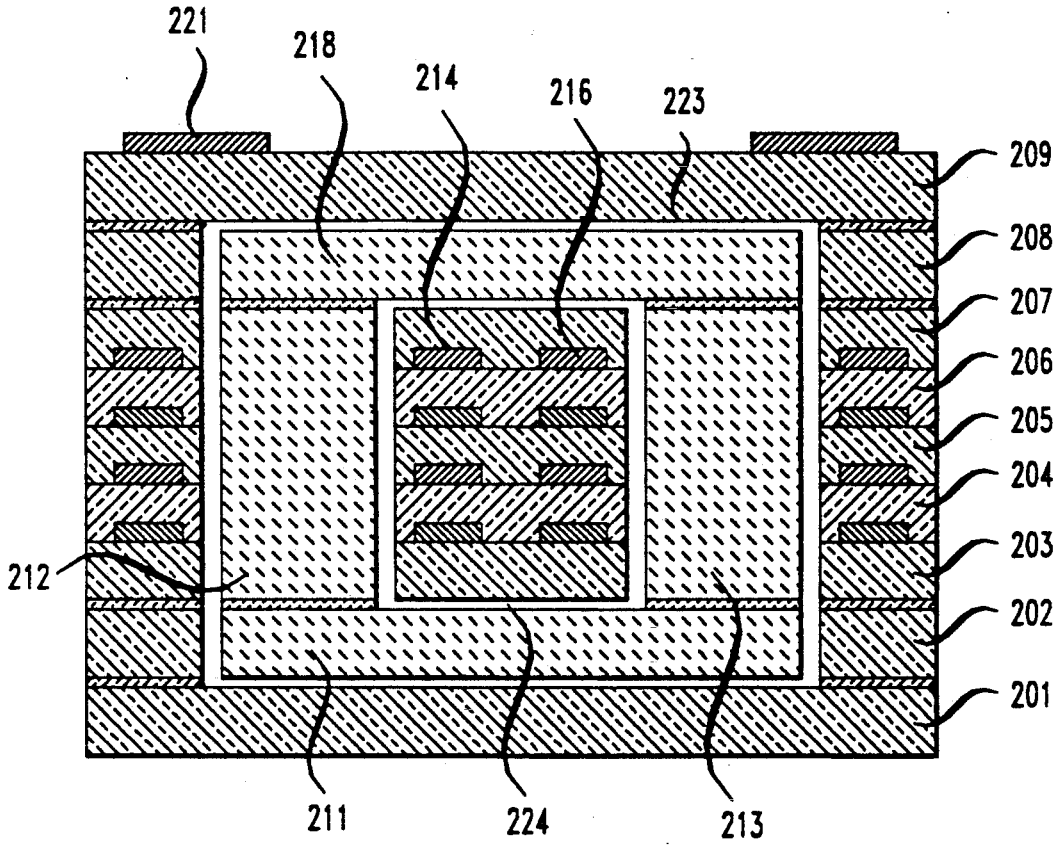
FIG. 2 is a cross-sectional view of the composite magnetic device of FIG. 1.

The effect of separating the magnetic and non-magnetic regions with removable material is to produce a device with physically separated regions as shown in FIG. 2. Specifically, FIG. 2 is a cross sectional view parallel to the XZ plane of the FIG. 1 device showing the individual tape layers and the spacing between regions. Member 201 is an insulating non-magnetic tape layer. Member 202 includes layers of non-magnetic tape each having an aperture within which a magnetic section 211 (shown as 101 in FIG. 1) is disposed in spaced apart relation to the insulating tape. The number of layers used to form members 202 and 211 is determined by the required magnetic cross section area. Members 203–207 forming the next section includes single layers of insulating non-magnetic tape having apertures for containing magnetic material sections 212 and 213 (shown as members 102 and 104 in FIG. 1). Members 203 through 206 contain conductor turns 214 and 216 printed on each individual layer. In this particular illustration a four turn winding is shown. It is to be understood that many added turns are possible by increasing the number of layers and by printing multiple concentric turns on each layer. Member 208 is similar to member 202 and includes an insulating non-magnetic tape having an aperture containing a spaced magnetic insert 218. The top number 209 is an insulating non-magnetic tape layer. Connector pads 221 are printed on the top surface to facilitate electrical connection to the windings.

The result of separating the magnetic and non-magnetic green ceramics with regions of removable material is the formation of a high permeability core within the insulating ceramic but physically separated from the insulating material by a spacing regions 223 and 224. This spacing occurs because during the heat treatment, the organic binders which hold the particles in the tapes together are "burned out". During the same heat treatment, the removable tape disintegrates into vapor species and leaves the structure through the pores between the yet unsintered ceramic particles. Since, in some applications, it may be undesirable to have a completely free floating core, a plurality of small posts or tabs (not shown) of non-removable material such as either magnetic or non-magnetic ceramic material can be inserted into the removable tape to anchor the core to the insulating housing. Such posts or tabs can also provide enhanced resistance to collapse. The posts or tabs have areas which are small compared to the areas of the removable material regions in which they are placed, typically each post will be less than 5% of the area.

Figure 3A:
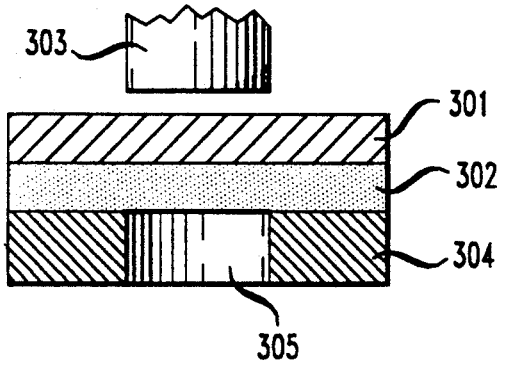
FIG. 3 illustrates a method of making layers useful in fabricating the device of FIGS. 1 and 2.
Figure 3B:
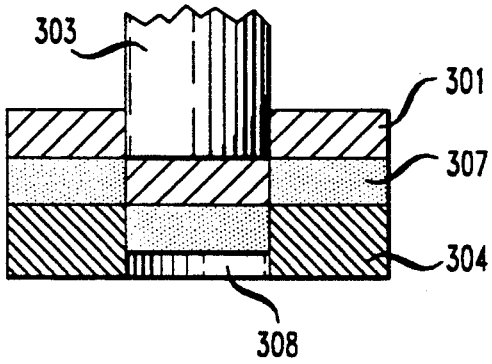

In order to make magnetic devices using removable spacing regions, it is important to be able to form multiregion tapes containing three or more different lateral regions with special spacing. The preferred method of forming such tapes is schematically illustrated in FIG. 3. Specifically, FIGS. 3A and 3B illustrate a preliminary step of forming a tape of removable material containing a region of magnetic material. In this step a tape of magnetic material 301 is disposed overlying a tape of removable material 302. The stacked layers are placed in a punch press comprising a male punch 303 in registration with a female die 304 having a recessed portion 305 with nominally the same width as the punch. Punch 303 is adjusted to punch the bottom of layer 301 to the bottom of layer 302. As shown in FIG. 3B, pressure from punch 303 results in the insertion of a region 306 of magnetic material from tape 301 into the removable tape to produce a new two region tape 307. The corresponding region 308 of the removable tape is ejected into the recessed portion of die 304.

Figure 3C:
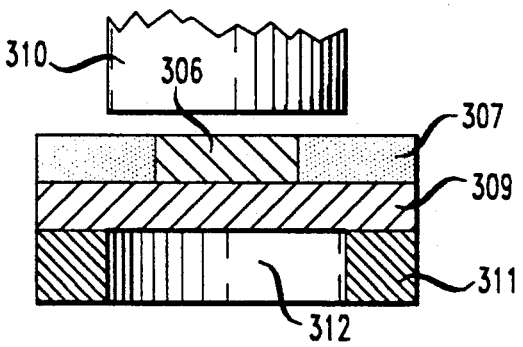
Figure 3D:
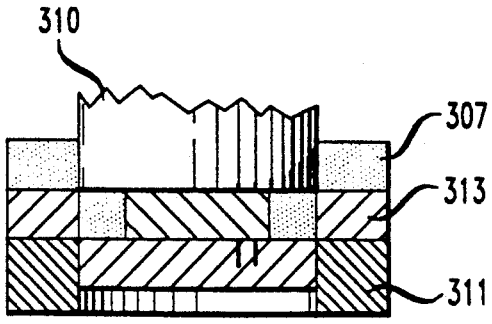

The next step shown in FIGS. 3C and 3D involves inserting a portion of two-region tape 307 into a non-magnetic, insulating tape to produce a three-region tape. Specifically, the two region tape 307 is disposed overlying a tape of non-magnetic, insulating material 309. A wider punch 310 with die 311 and recessed region 312 is then used to insert into layer 309 the magnetic region 306 and peripheral portions of removable material. The result is a multiregion tape 313 consisting of an outer region of non-magnetic material and an inner region of magnetic material separated from the non-magnetic material by removable material. The border of removable material preferably provides a spacing in the range 0.003–0.006 inch.

Figure 4:
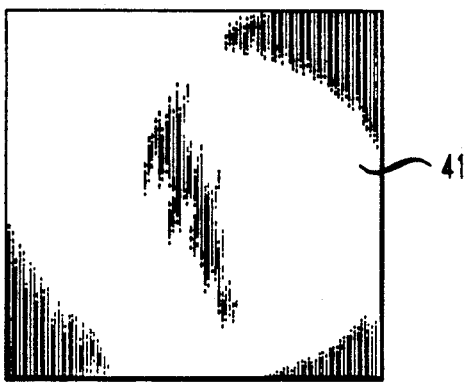
FIGS. 4–16 are planar views of the individual layers of the composite magnetic device of FIGS. 1 and 2.
Figure 5:
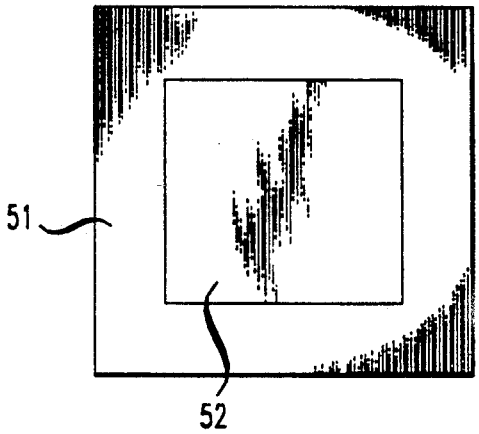
Figure 6:
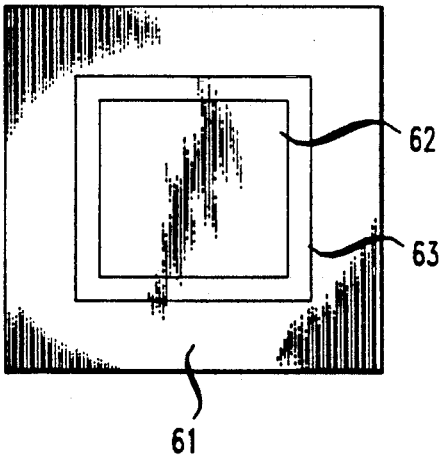
Figure 7:
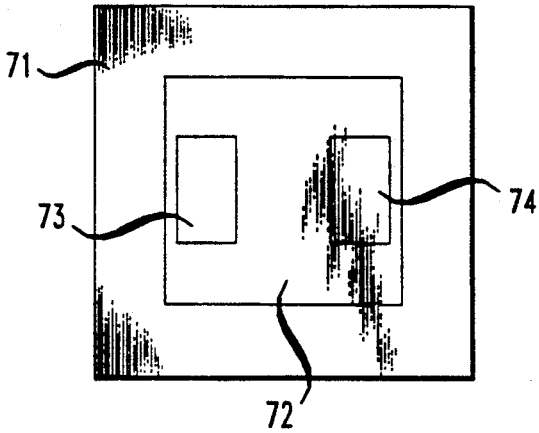

The fabrication of the magnetic device of FIGS. 1 and 2 using such multiregion tapes can be seen by reference to FIGS. 4 through 16 showing the individual layers of the composite magnetic device. FIG. 4 shows the bottom member as an insulating non-magnetic layer 41. FIG. 5 shows a top view of the next member above layer 41 and comprises an insulating non-magnetic tape 51 with an insert 52 of removable tape material. FIG. 6 comprises an insulating non-magnetic tape 61 with an insert 62 of magnetic material spaced from tape 61 by a peripheral layer of removable material 63. FIG. 7 comprises an insulating non-magnetic tape 71, a pair of magnetic inserts 73 and 74 and a region of removable material 72 disposed between the insulating material and the magnetic material.

Figure 8:
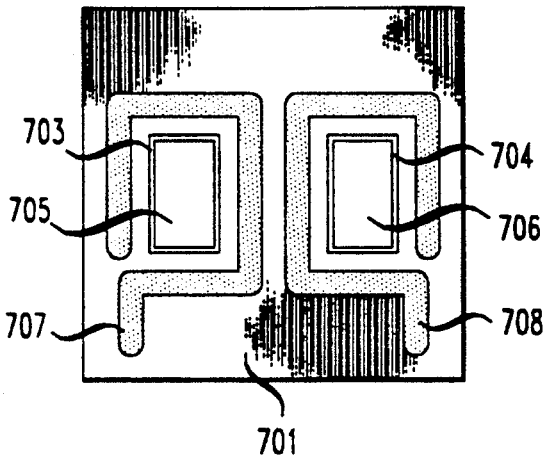

The next member in the structure is shown in FIG. 8 and comprises the insulating non-magnetic tape layer 701 containing magnetic inserts 705 and 706 separated from tape 701 by peripheral layers of removable material 703 and 704. Conductors 707 and 708 are printed onto the top surface of the tape layer 701. These conductors 707 and 708 each comprise a single turn of the transformer windings shown as windings 105 and 106 of FIG. 1. A single turn is shown surrounding each aperture; however multiple turns surrounding each aperture may be printed on each layer.

Figure 9:
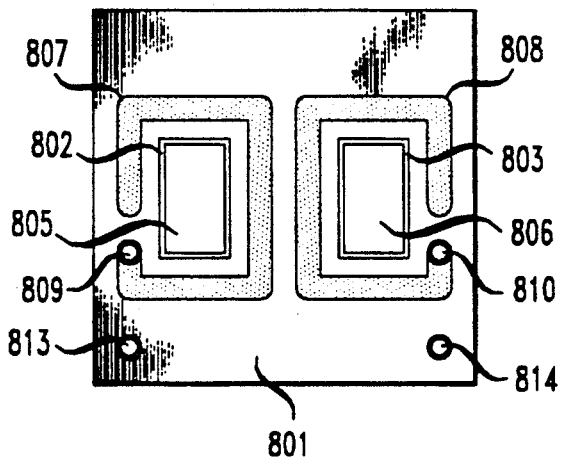

The next structural layer shown in FIG. 9 comprises an insulating non-magnetic layer 801 having magnetic inserts 805 and 806 spaced by peripheral regions 802 and 803 of removable material. The conductors 807 and 808 are the second set of turns in the windings. They are connected by vias 809 and 810 to the first set of turns printed on the previous layer shown in FIG. 8. The vias 813 and 814, which have ring-like pads on the surface of layer 801, connect to the other ends of the windings on layer 701 and correspond to similar vias in the above layers to connect to connector pads on the top surface of the structure. The ring-like pads surrounding the vias are included to simplify the alignment of vias in the various layers.

Figure 10:
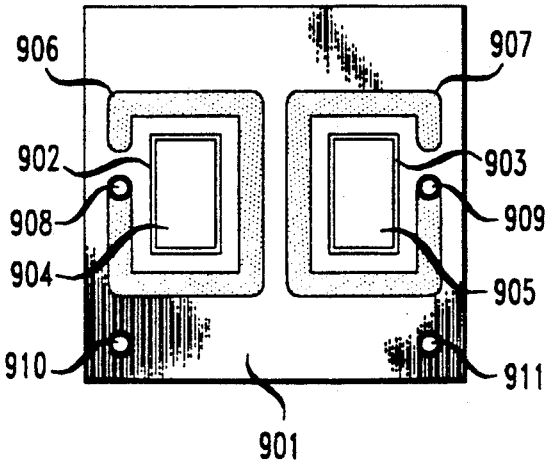

FIG. 10 shows the construction of the next member and includes an insulating non-magnetic tape layer 901 and magnetic tape inserts 904 and 905 spaced by peripheral regions 902 and 903 of removable material. The conductors 906 and 907 are the third set of turns in the windings and are connected by vias 908 and 909 to the second set of turns shown in FIG. 9. Vias 910 and 911 connect to the vias 813 and 814 in FIG. 9.

Figure 11:
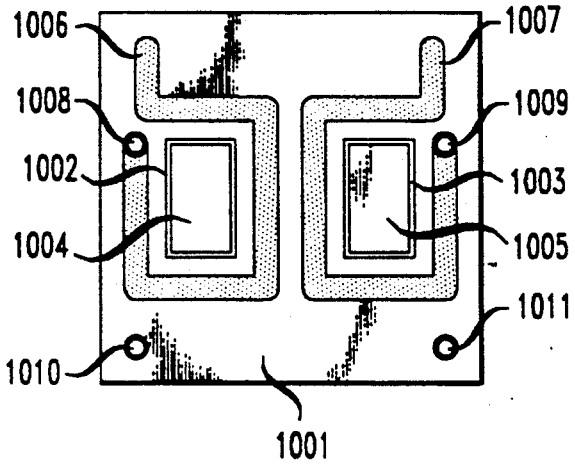

The next member shown in FIG. 11 includes an insulating non-magnetic tape layer 1001 with two magnetic inserts 1004 and 1005 spaced by peripheral regions of removable material 1002 and 1003. The winding turns 1006 and 1007 are the fourth set of turns. Vias 1008 and 1009 connect these conductors to the conductors of the previous layer of FIG. 10. Vias 1010 and 1011 are part of the conductive path coupling the conductors to the bottom layer with the connector pads on the top surface of the structure. While this is the last layer including windings, it is to be understood that the number of turns is illustrative only and that the structure may contain many additional turns.

Figure 12:
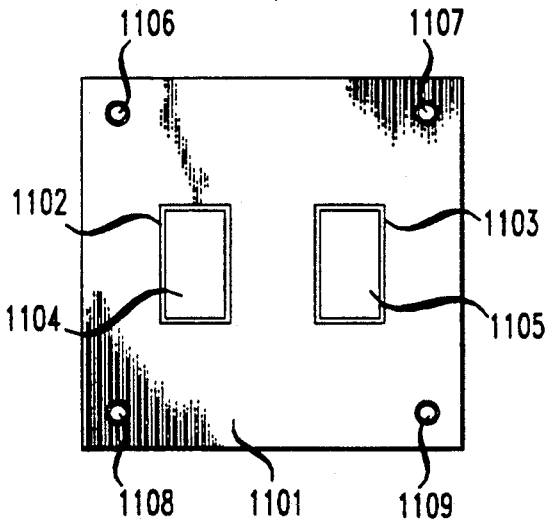

The member illustrated in FIG. 12 includes an insulating non-magnetic layer 1101 with magnetic tape inserts 1104 and 1105 spaced by peripheral regions of removable material 1102 and 1103. Conducting vias 1106 and 1107 connect to the conductors shown in FIG. 11 and conducting vias 1108 and 1109 are part of the conductive path coupling the conductors of the bottom layer with the connector pads on the top surface of the structure.

Figure 13:
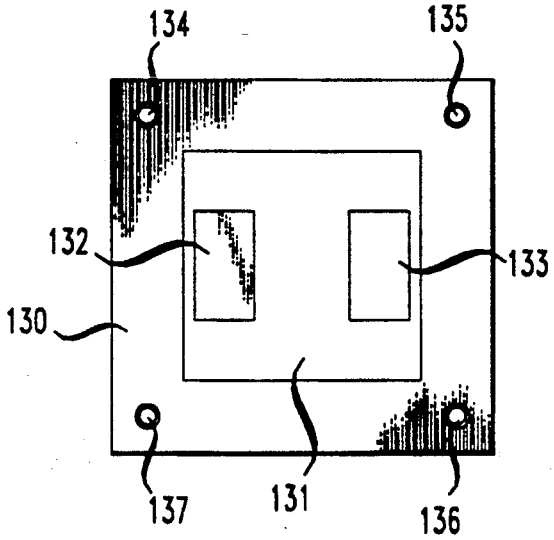

FIG. 13 is similar to FIG. 7. It includes an insulating non-magnetic layer 130 and inserts of magnetic tape 132 and 133 separated from layer 130 by a removable region 131. This member includes conducting vias 134, 135, 136 and 137 connected to corresponding vias of the adjacent members.

Figure 14:
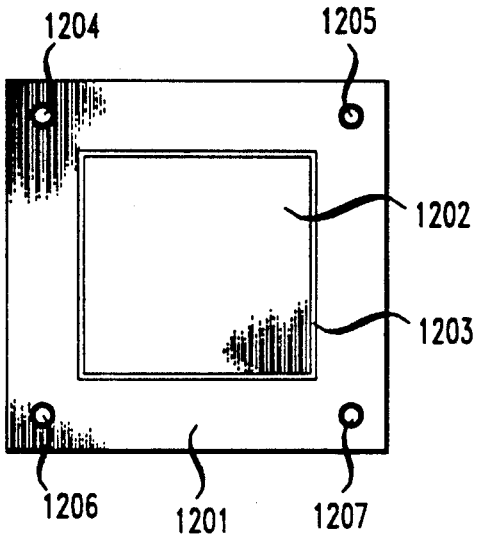

FIG. 14 is similar to FIG. 6. It includes an insulating non-magnetic layer 1201 and an insert of magnetic tape 1202 spaced by peripheral region of removable material 1203. In addition, this member includes conducting vias 1204, 1205, 1206 and 1207 connected to the corresponding vias of the adjacent members.

Figure 15:
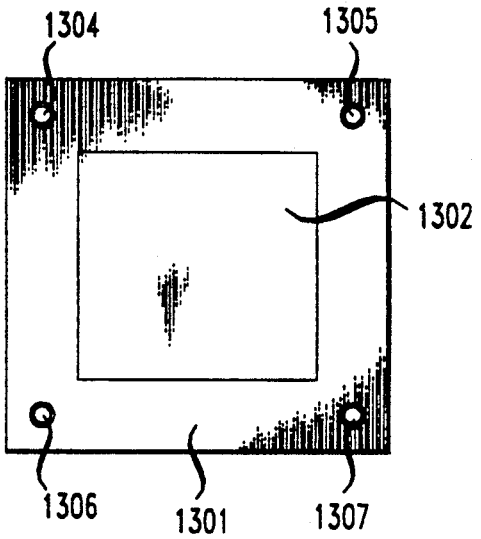

The member of FIG. 15 is similar to FIG. 5. It comprises an insulating non-magnetic layer 1301 and an insert of removable material 1302 to space magnetic tape 1202 of FIG. 14 from subsequent layers. Member 13 contains conducting vias 1304, 1305, 1306 and 1307 to connect corresponding underlying vias to the top member.

Figure 16:
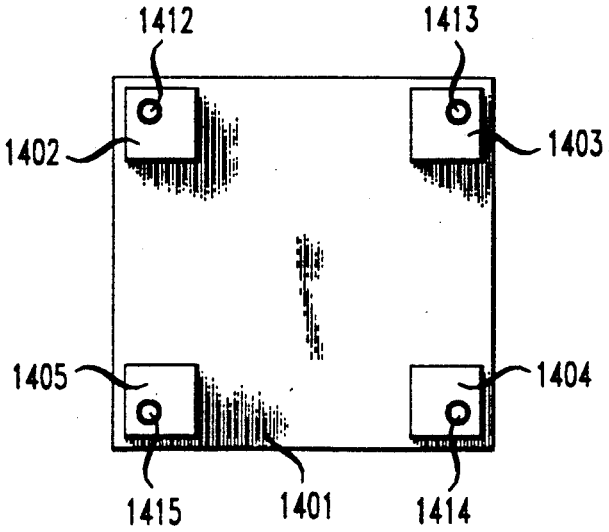

The top member shown in FIG. 16 includes an insulating non-magnetic layer 1401 and connector pads 1402 through 1405, each containing a conductive via 1412 to 1415, respectively, which provide connection to the corresponding vias in the previous member of FIG. 15.

In fabricating the device of FIGS. 1 and 2, the multiregion tapes shown in FIGS. 4–16 are prepared as illustrated in FIG. 3. Conductors having a composition compatible with the materials are printed on the layers of insulating non-magnetic green tape as needed to provide windings, and the successive layers are stacked in registration. The stacked structure is laminated under low pressure (500–3000 psi) at a temperature of 40° to 80° C., and the laminated structure is fired (sintered) at a temperature between 800° and 1500° C. to form the resulting composite structure of the magnetic component. During the early stages of firing, the removable material disintegrates, leaving the structure as volatile species. The residual precise spacing between the two types of constituent ceramic material alleviates fabrication problems due to different thermal characteristics of the two materials, thereby reducing cracking and degradation due to magnetostriction.

An alternative application of the process shown in FIG. 3 to the fabrication of magnetic devices concerns the formation of conductive elements such as vias 108 and windings 105 of FIG. 1. Rather than using printable conductive inks to form the conductive elements, one can form a configuration of removable material corresponding to the desired configuration of conductive elements and, after the removable material is eliminated during sintering, back fill the voids with fluid conductive material such as molten metal. For example, in accordance with this approach, removable material inserts would be substituted for conductive ink as elements 707 and 708 of FIG. 8, elements 807, 808, 809, 810, 813 and 814 of FIG. 9, elements 906 through 911 of FIG. 10, elements 1006 through 1011 of FIG. 11, elements 1106 through 1109 of FIG. 12, elements 134 to 137 of FIG. 13, elements 1204 through 1207 of FIG. 14, elements 1304 through 1307 of FIG. 15 and elements 1412 through 1415 of FIG. 16. Insulation between successive turns of the windings can be provided by additional members (not shown) similar to the members of FIG. 12 positioned between each set of turns. The result, upon sintering, is the formation of voids within the structure corresponding to the configuration of the desired conductors.

These voids are intentionally open to the surface so that they can then be filled with low melting temperature metal, such as solder, by immersing the structure in a molten bath to fill the empty spaces. After immersion, a vacuum can be drawn over the bath to remove gases in the helical voids and, subsequently, pressure can be applied to the bath to ensure the flow of metal into the voids.

The advantage of this approach is that one can form relatively thick conductors of high current-carrying capacity rather than thin printed layers. Moreover relatively inexpensive metals can be substituted for costly precious metal conductive inks.

It is to be understood that the above-described embodiments are illustrative of only a few of the many possible specific embodiments which can represent applications of the principles of the invention. For example, while the invention has been described in connection with a transformer structure having conductive windings with vertical axes, it is clear that the same approach can be used to make transformers with horizontal axes such as those described in the aforementioned Grader et al application. It can also be used to make even more complex magnetic devices such as motors. Thus numerous and varied other arrangements can be readily devised in accordance with these principles by those skilled in the art without departing from the spirit and scope of the invention.

We claim:

1. In the method of making a magnetic device comprising the steps of forming a plurality of layers comprising one or more insulating regions and one or more magnetic regions, forming a stack of said layers, laminating said stack and sintering the laminated stack, the improvement wherein:

at least one layer of said plurality comprises a region of removable material for dissipating prior to completion of sintering disposed between said insulating regions and said magnetic regions thereby separating said insulating and magnetic regions.

2. The method of claim 1 wherein each layer of said plurality comprises a region of removable material disposed between said insulating regions and said magnetic regions.

3. The method of claim 1 wherein said plurality of layers comprise outer insulating regions and inner magnetic regions to form a magnetic device having an outer insulating region substantially surrounding one or more inner magnetic regions spaced apart from said outer insulating region.

4. The method of claim 1 further comprising the step of forming one or more conductors in said insulating regions.

5. The method of claim 4 wherein said conductors wind around at least one magnetic region.

6. The method of claims 4 or 5 wherein said conductors are formed by providing said insulating regions with regions of removable material in the configuration of the desired conductor, effecting the dissipation of said removable material prior to the completion of sintering, and back-filling with fluid conductive material the voids created by said dissipation.

7. The method of claim 1 wherein said region of removable material includes a plurality of non-removable supporting post regions having areas small compared to the area of the region of removable material.

* * * * *